US008968220B2

(12) United States Patent
Han et al.

(10) Patent No.: US 8,968,220 B2
(45) Date of Patent: Mar. 3, 2015

(54) WEARABLE ROBOTIC SYSTEM FOR REHABILITATION TRAINING OF THE UPPER LIMBS

(75) Inventors: Jungsoo Han, Seoul (KR); Changsoo Han, Seoul (KR); Hyeyoen Jang, Seoul (KR); Jaeho Jang, Seongnam (KR); Youngsu Lee, Ansan (KR); Sungjoon Hong, Gunpo (KR)

(73) Assignees: Industry-University Cooperation Foundation Hanyang University Erica Campus, Ansan-si, Seoul (KR); Hansung University Industry-University Cooperation, Seoul (KR)

( * ) Notice: Subject to any disclaimer, the term of this patent is extended or adjusted under 35 U.S.C. 154(b) by 899 days.

(21) Appl. No.: 13/139,903

(22) PCT Filed: Dec. 30, 2008

(86) PCT No.: PCT/KR2008/007764

§ 371 (c)(1),
(2), (4) Date: Jun. 15, 2011

(87) PCT Pub. No.: WO2010/071252

PCT Pub. Date: Jun. 24, 2010

(65) Prior Publication Data

US 2011/0251533 A1 Oct. 13, 2011

(30) Foreign Application Priority Data

Dec. 16, 2008 (KR) ..... 10-2008-0127942

(51) Int. Cl.

| | |
|---|---|
| ***A61H 1/02*** | (2006.01) |
| ***A63B 21/00*** | (2006.01) |
| ***A63B 23/12*** | (2006.01) |
| ***A63B 24/00*** | (2006.01) |
| ***A63B 69/00*** | (2006.01) |
| *A63B 21/005* | (2006.01) |
| *A63B 22/00* | (2006.01) |

(52) U.S. Cl.

CPC ..... *A61H 1/0274* (2013.01); *A63B 21/00178* (2013.01); *A63B 21/00181* (2013.01);
(Continued)

(58) Field of Classification Search

CPC ..... A61H 1/00; A61H 1/0274; A61H 1/0277; A61H 1/0281; A61H 2001/00; A61H 2001/0203; A61H 2201/123; A61H 2201/1609; A61H 2201/1614; A61H 2201/165; A61H 2201/5064; A61H 2203/0406; A61H 2205/062; A61H 2205/06

USPC ..... 601/5, 23, 33, 84, 85, 86, 87, 89, 91, 601/93, 97, 98, 101; 602/5, 16, 19, 20, 21

See application file for complete search history.

(56) References Cited

U.S. PATENT DOCUMENTS

| | | | | |
|---|---|---|---|---|
| 4,651,719 | A | 3/1987 | Funk et al. | |
| 5,179,939 | A * | 1/1993 | Donovan et al. | 601/33 |

(Continued)

FOREIGN PATENT DOCUMENTS

| | | |
|---|---|---|
| KR | 1020020054574 | 7/2002 |
| KR | 1020080080035 | 9/2008 |
| KR | 1020080092346 | 10/2008 |

OTHER PUBLICATIONS

International Search Report for international application No. PCT/KR2008/007764, dated Sep. 2, 2009 (2 pages).

(Continued)

*Primary Examiner* — Quang D Thanh

(74) *Attorney, Agent, or Firm* — Hamre, Schumann, Mueller & Larson, P.C.

(57) ABSTRACT

The present invention relates to a wearable robot system for rehabilitation training of the upper limbs that has an improved structure to reproduce in detail motion of a human body by selecting a wearing type structure such that robot links move correspondingly to the motion of the upper limbs while decreasing the volume of a rehabilitation and assistance device based on a robot for rehabilitation training of the upper limbs. According the present invention, it is possible to decrease the volume and increase the available space, in addition to creating smooth motion without interfering with the human body by creating a plurality of robot motion paths and selecting the best path from them, because an operation of four degrees of freedom can be achieved by an operation procedure using redundant.

12 Claims, 10 Drawing Sheets

(52) U.S. Cl.
CPC ..... *A63B23/1245* (2013.01); *A63B 24/0006* (2013.01); *A63B 69/0059* (2013.01); *A61H 2201/165* (2013.01); *A61H 2201/5064* (2013.01); *A63B 21/0058* (2013.01); *A63B 2022/0094* (2013.01); *A63B 2220/52* (2013.01)
USPC ..... 601/5; 601/23; 601/33

(56) References Cited

U.S. PATENT DOCUMENTS

| | | | | |
|---|---|---|---|---|
| 5,417,643 | A | 5/1995 | Taylor | |
| 6,007,500 | A | 12/1999 | Quintinskie, Jr. | |
| 6,821,259 | B2 | 11/2004 | Rahman et al. | |
| 6,929,616 | B2 | 8/2005 | Bonutti et al. | |
| 7,367,958 | B2 | 5/2008 | McBean et al. | |
| 2007/0225620 | A1 * | 9/2007 | Carignan et al. | 601/5 |
| 2009/0281465 | A1 * | 11/2009 | Fu et al. | 601/5 |
| 2013/0237883 | A1 * | 9/2013 | Malosio et al. | 601/33 |

OTHER PUBLICATIONS

Written Opinion for international application No. PCT/KR2008/007764, dated Sep. 2, 2009 (3 pages).

* cited by examiner

WEARABLE ROBOTIC SYSTEM FOR REHABILITATION TRAINING OF THE UPPER LIMBS

BACKGROUND OF THE INVENTION

1. Field of the Invention

The present invention relates to a wearable robotic system for rehabilitation training of the upper limbs, particularly a wearable robotic system for rehabilitation training of the upper limbs having an improved structure for helping rehabilitation training of the upper limbs of an old person with weak muscular strength, a handicapped person, or a rehabilitation patient without interfering with the motions of the body.

2. Description of the Related Art

In general, a human body has a structure in which parts near joints pivot about the joints and generally have to move for over 6 hours a day to maintain their functions.

However, a patient who has had an operation on a joint cannot move by himself/herself, such that muscles weaken and nutrition is insufficient, and as a result, the joint may become stiff and rigid.

Therefore, the patient is required to endure rehabilitation exercise with pain for a long time to prevent deformation of the joint and return to a normal life.

Further, in addition to patients, old people whose muscular strength are weakened by aging or handicapped people need an auxiliary device for rehabilitation training of the upper limbs.

The shoulder joint is connected by the humerus and the scapula, and extension/flexion, abduction/adduction, and internal/external rotation are performed by several muscles including the pectoralis major muscle, the latissimus dorsiflap, and the deltoid. The interval between the humerus and the scapula is formed in a shape that is the most similar to a ball-socket joint, and has been researched under the assumption that it is a ball-socket joint in design. Further, the elbow joint is composed of the radius, ulna, and humerus.

Most general medical instruments are not more than simple auxiliary devices having only a function that restrains the angle of each joint after an operation on the joint such that the patient does not perform any excessive motions. Further, various researches have been conducted for walking assistance devices that change the angle of joints using an actuator.

That is, the existing assistance devices have only a function of restraining the angle of joints, but, unlike those, CPM (Continuous Passive Motion) devices that are used for rehabilitation training of knee joints have been recently on the market domestically and internationally.

The CPM devices have functions that bend/stretch the knee, set an angle, set an operation time, and set the number or repeat time, etc., and also have functions that vibrate and progress motion.

The devices have a technical characteristic in that they are applied only to knee joints that are involved in the lower limbs that are the most frequently used.

On the other hand, as for a product for the upper limbs, MYOMO (developed by MIT) has been developed in the United States. However, it is limited in that it is difficult to be used for different people and allows only one degree of freedom for the elbow, because it selects an EMG as a motion intent signal.

Further, products by KINCOM and BIODEX, which are expensive and have been developed in foreign countries, are uncomfortable to wear because only the end of a robot link is fixed to the part that needs rehabilitation. Further, they have a limit on the space where they are installed because they can integrally rehabilitate all joints on the basis of a robot having five to seven degrees of freedom.

SUMMARY OF THE INVENTION

In respects to the above problems, an object of the present invention is to provide a wearable robot system for rehabilitation training of the upper limbs that has an improved structure to reproduce in detail motion of a human body by selecting a wearing type structure such that robot links move correspondingly to motion of the upper limbs while decreasing the volume of a rehabilitation and assistance device based on a robot for rehabilitation training of the upper limbs.

Further, another object of the invention is to provide a wearable robotic system for rehabilitation training of the upper limbs that can be selectively used on the basis of the user's intent by allowing the user to select CPM (Continuous Passive Motion), in addition to allowing the robot to make active exoskeletal motion in response to a signal even from a slight motion intent, using load cells to assist the muscular force.

In order to accomplish the objects of the present invention, a wearable robot system for rehabilitation training of the upper limbs, includes: a robot unit that is attachable/detachable to/from the upper limbs of a human body by an attaching means and has a plurality of joint driving units and an elbow joint driving unit for extension/flexion of the elbow joint and the shoulder joint and abduction/adduction of the shoulder joint of the human body; a station unit that supports the robot unit and adjusts up/down positions and left/right positions of the robot; a sensing unit that is disposed in the robot unit, detects motion of the upper limbs of the human body using sensors, and outputs the detected signals into an electric signal; and a control unit that controls the operation of the shoulder joint driving unit and the elbow joint driving unit in response to the signal output from the sensing unit.

The station unit includes: a movable bed that is disposed to fix the end of the robot unit 300 and actuated by a linear actuator to move the robot unit 300 to the left and right such that the rotational center of the shoulder meets with the rotational center axis of the robot to improve wearing comfort; an elevation bed that is disposed under the movable bed to expand/contract and actuated by a linear actuator to move the movable bed up/down; and a base that is disposed under the elevation bed to support the elevation bed.

The sensing unit has a plurality of load cells that are disposed at a side of the load cell and outputs an electric signal corresponding to force transmitted from the upper limbs of the human body.

The sensing unit includes: a first load cell that detects movement of the elbow joint using a one-axial detection method and outputs a motion intent signal corresponding to the movement; and a second load cell that is spaced apart from the first load cell, detects movement of the elbow joint using a two-axial detection method, and outputs a motion intent signal corresponding to the movement.

The attaching means is a binding band that is disposed in a string shape at a side of the robot unit and of which both ends are attachable and detachable by hook and loop fastener (e.g., Velcro®) tapes.

The robot unit includes connecting links that are each disposed between the shoulder joint driving unit and the elbow joint driving unit and rotatably connected while surrounding the shoulder.

The shoulder joint driving unit and the elbow joint driving unit each have: motors that are driven in response to an electric signal applied from the outside and provide rotational force to the connecting links; and a power transmitting unit that transmits the driving force of the motors to the connecting links.

The robot unit has first, second, third, and fourth shoulder joint driving units that are connected each other by the connecting links such that the central axis of the motors of the first, second, third, and fourth shoulder joint driving units are arranged to cross the central axis of the shoulder joint of the human body.

The connecting link disposed between the fourth shoulder driving unit and the elbow joint driving unit has: upper link arms that are disposed to correspond to an upper arm of the human body and divided to adjust the up-down length by a connecting means; and lower links arms that are disposed at the end of the elbow joint driving unit to correspond to an lower arm of the human body.

The shoulder joint driving units are arranged at different angles through the connecting links such that the robot does not interfere with the human body.

The wearable robot system for rehabilitation training of the upper limbs further includes a selecting means that allows a user to select a voluntary motion mode or a continuous passive motion mode for the operation of the robot unit, in which the selecting means that makes the control unit control the operation of the shoulder joint driving unit and the elbow joint driving unit, in response to signal transmitted from a selecting switch for selecting the voluntary motion mode or the continuous passive motion mode.

The present invention relates to a wearable robot system for rehabilitation training of the upper limbs that has an improved structure for assisting motion of the limbs of old people, handicapped people, and rehabilitation patients without interfering with the motion of the upper limbs of a human body. According to this configuration of the present invention, it is possible to decrease the volume and increase the available space, in addition to create smooth motion without interfering with the human body by creating a plurality of robot motion paths and selecting the best path from them, because an operation of four degrees of freedom can be achieved by an operation procedure using redundant.

Further, it is possible to select one of a voluntary motion mode that is operated by the user's intent and a continuous passive motion, to move the user's upper limbs.

Further, it is possible to simplify sensing motion intent signals by minute movement of the user's muscles, using a plurality of load cells.

Further, it is possible to create smooth motion without interfering with the human body because the central axis of each of motors of the shoulder joint driving units crosses the central axis of the elbow joint.

DESCRIPTION OF THE PREFERRED EMBODIMENTS

Figure 1:
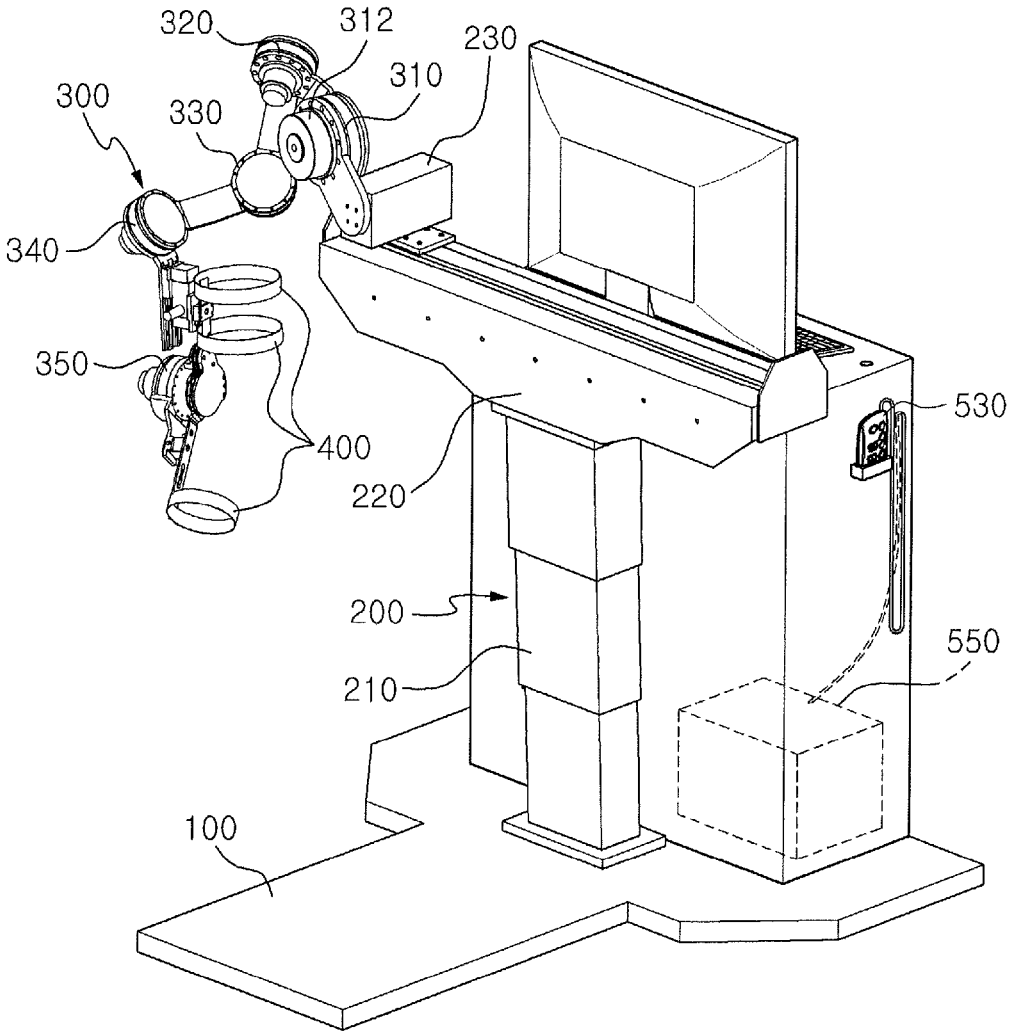
FIG. 1 is a perspective view showing the configuration of a wearable robotic system for rehabilitation training of the upper limbs according to the present invention.
Figure 2:
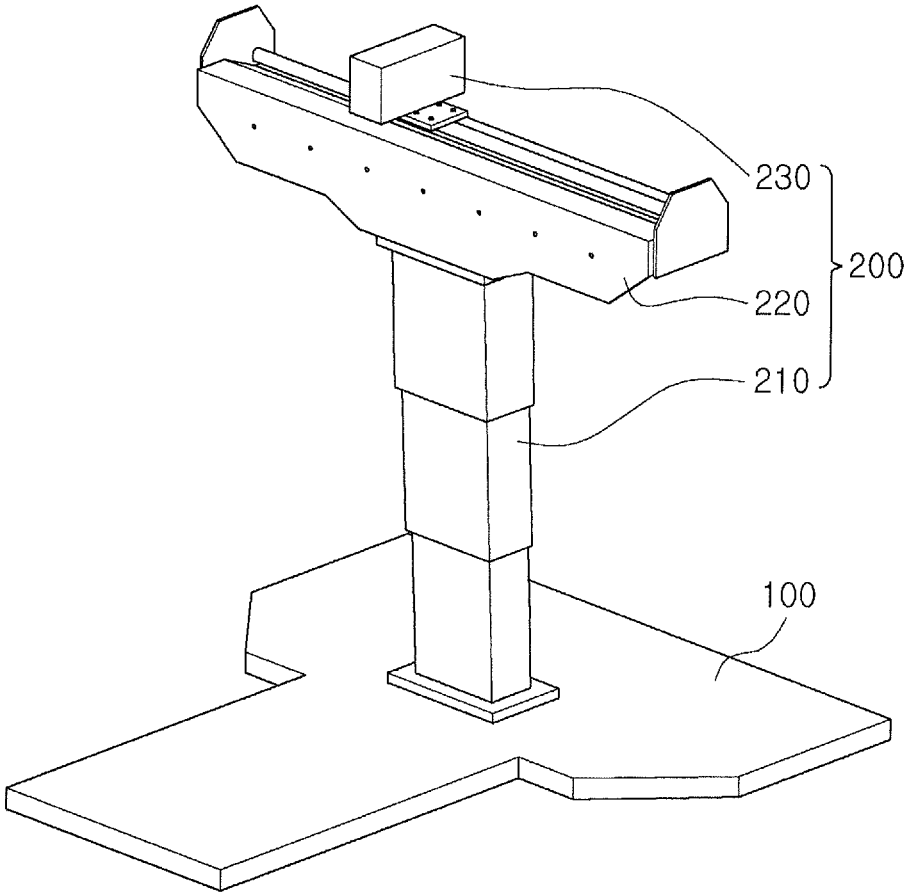
FIG. 2 is a perspective view showing a station unit according to the present invention.
Figure 3:
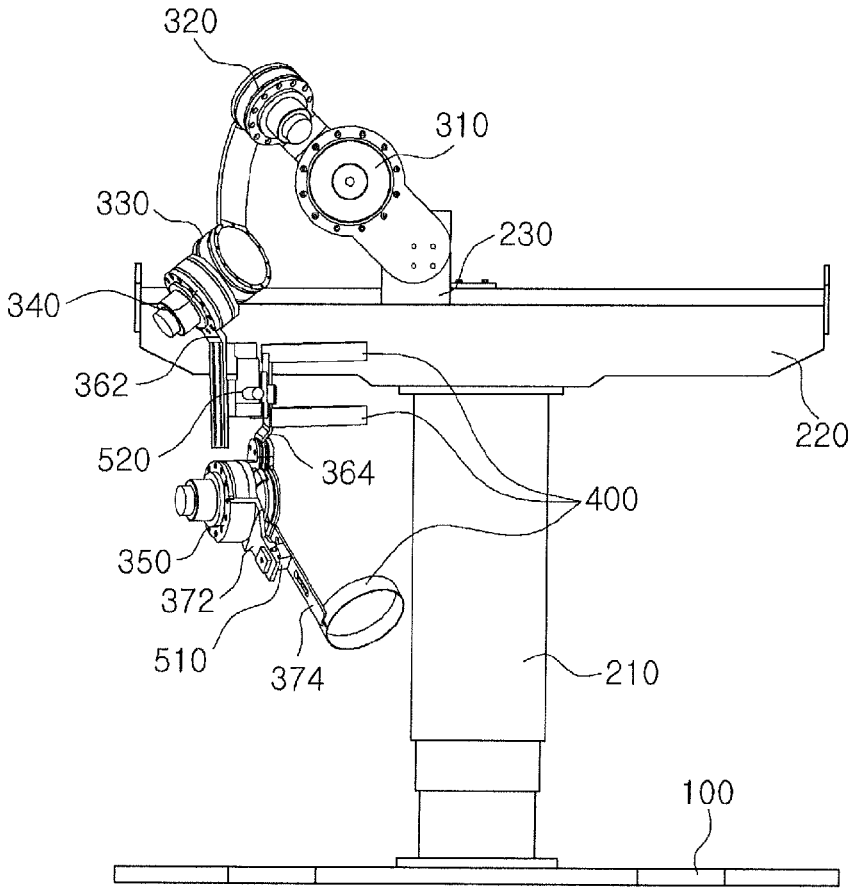
FIG. 3 is a front view showing an assembly of the station unit and a robot unit according to the present invention.
Figure 4:
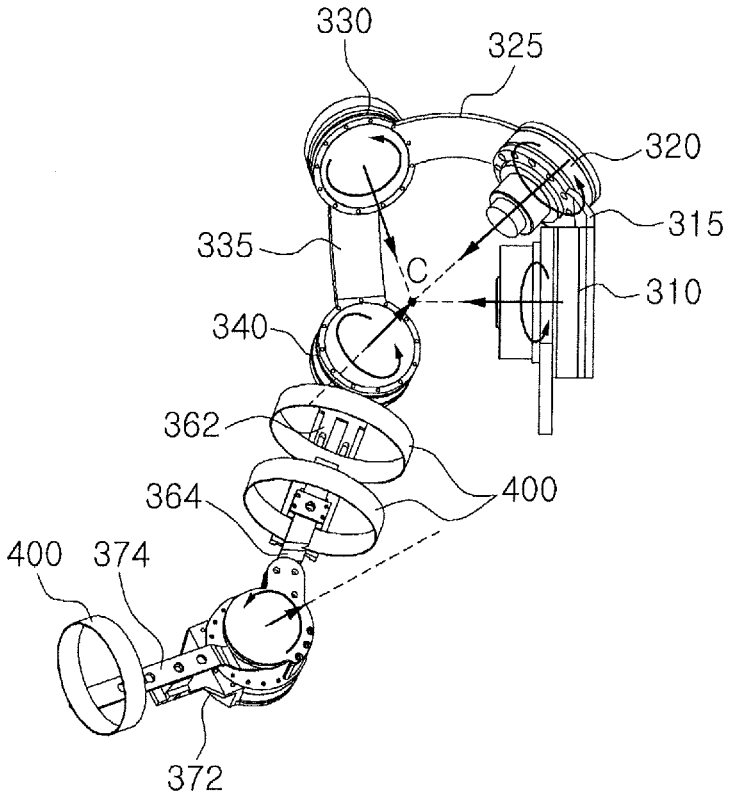
FIG. 4 is a perspective view showing the robot unit according to the present invention.
Figure 5:
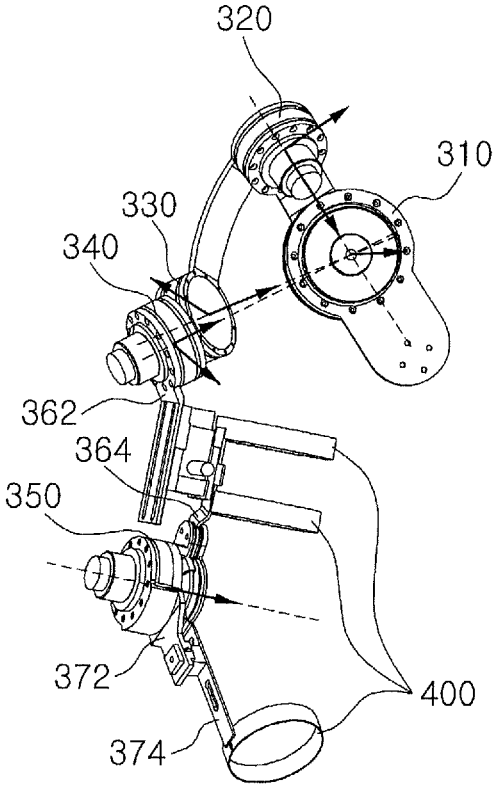
FIG. 5 is a perspective view of the robot unit seen from another direction, according to the present invention.
Figure 6:
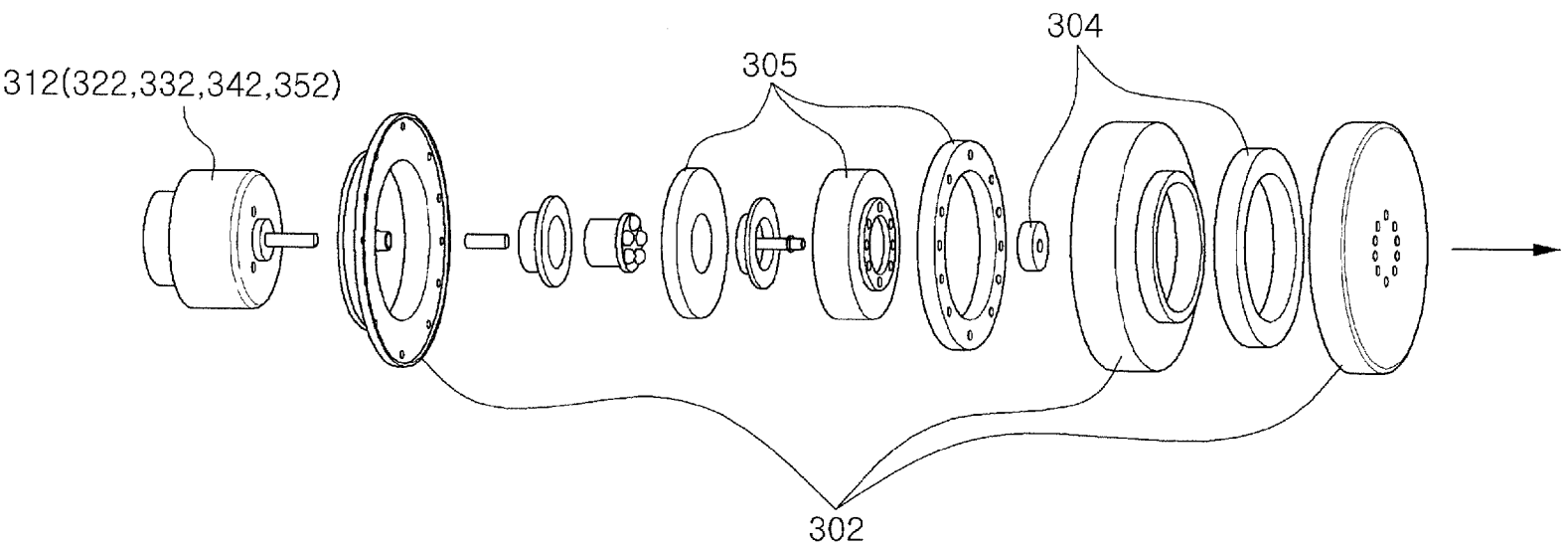
FIG. 6 is an exploded perspective view showing the internal structure of a driving unit according to the present invention.
Figure 7:
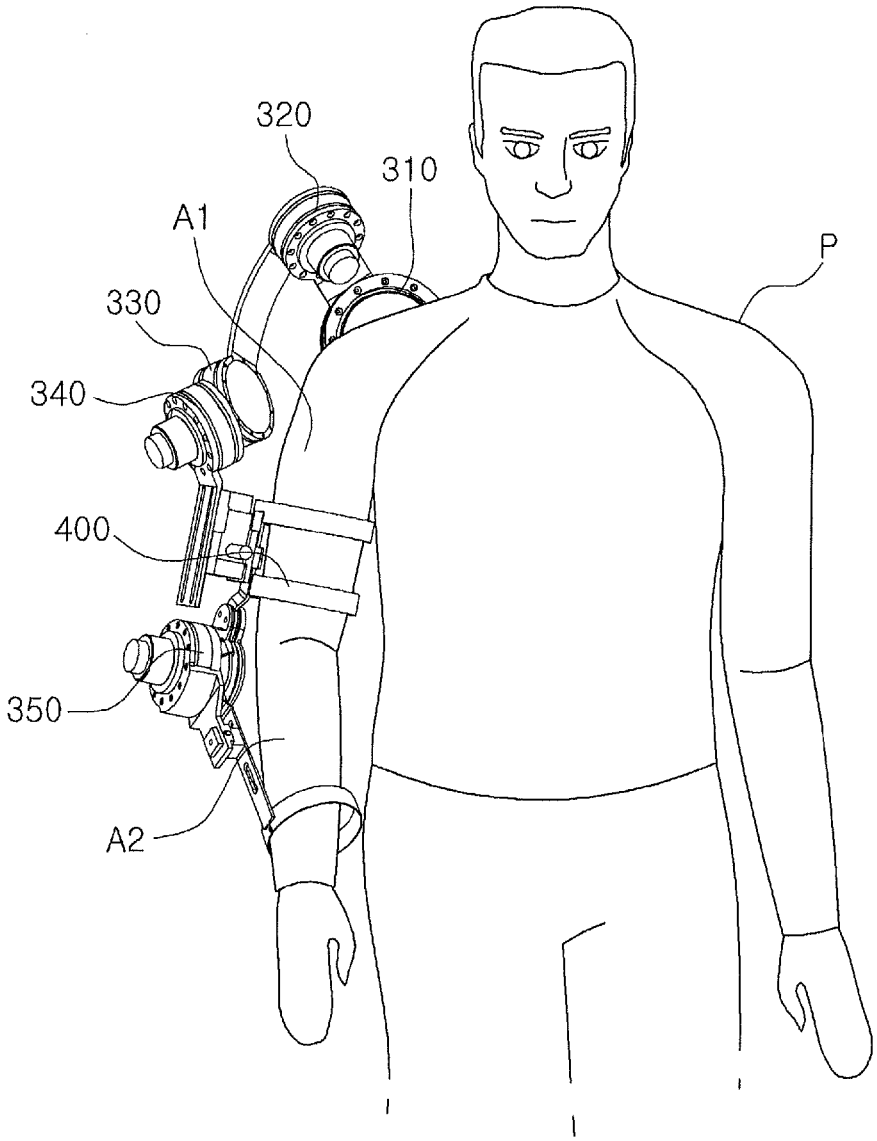
FIG. 7 is a view illustrating the use of the wearable robotic system worn on the upper limb of a human body by an attaching means according to the present invention.
Figure 8:
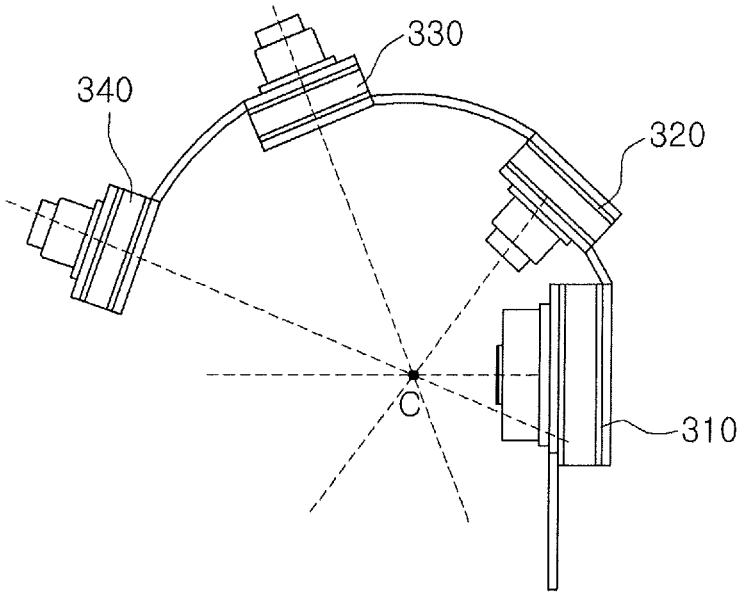
FIG. 8 is a view illustrating that a motor shaft of the robot unit crosses the central axis of the shoulder joint of a human body according to the present invention.

Preferred embodiments of the present invention are described hereafter with reference to the accompanying drawings.

Referring to FIGS. 1 to 10, a wearable robot system for rehabilitation training of the upper limbs according to the present invention includes: station unit 200 disposed on a base 100, which is fixed to the ground, and having an elevation bed 210 that can reciprocate up/down and a movable bed 220 that is disposed over the elevation bed 210; a robot unit 300 that is connected with the movable bed 220 of the station unit 200, attachable/detachable to/from the upper limbs of a human body P by an attaching means, and has a plurality of shoulder joint driving units 310, 320, 330, 340 and an elbow joint driving unit 350 for extension/flexion of the elbow joint and the shoulder joint and abduction/adduction of the shoulder joint of the human body; a sensing unit that is disposed in the robot unit 300, detects motion of the upper limbs of the human body using sensors, and outputs the detected signals into an electric signal; and a control unit 550 that controls the operation of the shoulder joint driving unit and the elbow joint driving unit 350 in response to the signal output from the sensing unit.

In detail, in the robot unit 300, connecting links 315, 325, 335, 362, 364 are disposed between the shoulder joint driving unit and the elbow joint driving unit 350 and rotatably connected with each other, such that each of the driving units are rotatably connected through the connecting links.

Further, the shoulder joint driving unit of the robot unit 300 is composed of first, second, third, and fourth shoulder joint driving units 310, 320, 330, 340 that can each rotate by the connecting links 315, 325, 335 such that it has four degrees of freedom using redundant.

That is, the shoulder joint driving unit is additionally provided with a redundant operation driving portion, in addition to a three-degree of freedom operation of extension/flexion, abduction/adduction, and internal/external rotation, such that smooth motion of three degrees of freedom is possible by four driving units having four degrees of freedom.

The first, second, third, and fourth shoulder joint driving units 310, 320, 330, 340 and the elbow joint driving unit 350 respectively include known motors 312, 322, 332, 323, 352 each having a motor shaft that operates in response to an electrical signal applied from the outside and provided to supply rotational force to the connecting links 315, 325, 335, and a power transmitting unit that transmits the driving force of the motors to the connecting links 315, 325, 335.

The motor is a flat motor, which is known in the art.

Further, each of the shoulder joint driving units are disposed at different angles such that the human body does not interfere with the robot unit 300 through the connecting links 315, 325, 335, which is for preventing interference between the shoulder joint driving units that are in operation and the human body.

An upper link arm that is divided to adjust the length in the up-down direction by a connecting means is disposed between the fourth shoulder joint driving unit 340 and the elbow joint driving unit 350 to correspond to the upper arm A1 of the human body, while a lower link arm that is divided into first and second lower link arms 372, 374 is disposed at the end of the elbow joint driving unit 350 to rotatably correspond to the lower arm A2.

The upper link arm is divided into first and second upper link arms 362, 364 and the connecting means is composed of a connecting bolt (not shown) and a connecting nut (not shown) which each have a connection hole at the end where the first and second upper link arms 362, 364 overlap each other and fixes the first and second upper link arm 362, 364 using fastening force.

In more detail, the first, second, third, and fourth shoulder joint driving units 310, 320, 330, 340 are designed to surround the shoulder of the human body and arranged such that the centers of the motor shafts cross the center axis C of the shoulder joint of the human body. This configuration is designed such that the motor shafts of the shoulder joint driving units cross the central axis C of the human body and make appropriate motions, on the assumption that the shoulder joint of the human body moves like a ball-socket joint.

The power transmitting unit operates to transmit the rotation of the motor shafts of the motors to the connecting links 315, 325, 335, in which a known harmonic drive 305 and a plurality of bearings 304 for preventing eccentricity is disposed in a plurality of divided cases 302, which is a well-known structure in the related art and detailed description is not provided.

The control unit 550 may be a controller equipped in a well-known computer in the related art and needs an operating unit that outputs signals for controlling the operation of the driving units of the robot unit 300 and the operation of the station unit 200.

The operating unit may be operated by a remote control switch that a user directly operates or a keyboard that a manager operates.

It is preferable to further provide a selecting means for selecting a voluntary motion mode or a continuous passive motion mode for the operation of the robot unit 300, depending on the selection of the user. The selecting means allows the control unit 550 to control each of the shoulder joint driving unit and the elbow joint driving unit 350, in response to a signal transmitted from a selection switch 530 for selecting the voluntary motion mode or the continuous passive motion (CPM) mode.

The voluntary motion mode is a motion mode that is assisted by the robot unit 300 according to the motion intent when a user voluntarily applies force to the elbow or shoulder joint, while the continuous passive motion mode is a motion mode that forcibly moves the user's upper arm along a predetermined path set by programming. The station unit 200 is disposed on the base 100 and includes the elevation bed 210 that is expanded/contracted up/down by a well-known linear actuator and a movable bed 220 that is disposed over the elevation bed 210 and moves the robot unit 300 to the left and right such that rotational center of the shoulder meets the rotational center of the robot to maximize wearing comfort when the first shoulder joint driving unit 310 of the robot unit 300 is put on the human body by the linear actuator.

The movable bed 220 can move left/right along a rail provided at the upper portion and has a movable frame 230 where the first shoulder joint driving unit is integrally fixed.

The sensing unit includes a first load cell 510 that is a sensor detecting the movement of the elbow joint and a second load cell 520 that is a sensor detecting the movement of the shoulder joint.

The first and second load cells 510, 520 that detect the movement of the elbow joint or the shoulder joint in motion intent signals are spaced apart from each other to correspond to the upper arm and the lower arm of the human body. The first load cell 510 is disposed where the first and second lower link arms 372, 374 are connected, and detects movement of a muscle for extension/flexion, which is transmitted to the first and second lower link arms 372, 374, in one-axial movement of extension/flexion, converts the detected result into a motion intent signal and then outputs the signal to the control unit 550.

The second load cell 520 is disposed where the first and second upper link arms 362, 364 are connected, and detects a two-axial movement according to the movement of a muscle of the upper arm A1 for moving the shoulder joint, in a three-directional movement of x, y, z, and then outputs a motion intent signal to the control unit 550.

In the shoulder joint herein, the force x is force that is input in internal/external rotation and the force z is force that is input in extension/flexion.

Since the maximum rotational angle of the shoulder joint is 145°, it is preferable to set a limit angle to 120° or less for a safe operation.

Further, because the allowable range of the shoulder joint of the human body is 0 to 180° for flexion, 0 to 50° for extension, 0 to 180° for abduction, 180 to 0° for adduction, 0 to 90° for internal rotation, and 90 to 0° for external rotation, it is preferable to limit the angle of the first, second, third, and fourth shoulder joint driving units 310, 320, 330, 340 within the ranges.

The attaching means are disposed apart from each other at a side of the robot unit 300 in a plurality of string shapes and composed of binding bands 400 of which both ends are attachable/detachable by hook and loop fastener (e.g., Velcro®) tapes.

The operation having the above configuration of the present invention is described hereafter.

The wearable robot system for rehabilitation training of the upper limbs according to the present invention moves up/down the elevation bed 210 of the station unit 200 such that the robot unit 300 is correspondingly positioned to the user's shoulder, depending on the body conditions of the user.

Then, the first shoulder joint driving unit 310 fixed to the movable frame 230 is moved left/right to a desired position by moving left/right the movable frame 230 disposed on the rail of the movable bed 220.

Thereafter, the user or the manager selects a desired mode from the voluntary motion mode or the continuous passive motion mode.

When the user selects the voluntary motion mode, the first and second load cells 510, 520 disposed to correspond to the user's upper arm and lower arm detect minute movement of muscles of the user and output a motion intent signal to the control unit 550, and the control unit 550 rotates the connecting links 315, 325, 335 by driving the motors 312, 322, 332, 342 of the first, second, third, and fourth shoulder joint driving units 310, 320, 330, 340 in response to the motion intent signal transmitted from the first and second load cell 510, 520 to help motion of the user's limbs.

Figure 9:
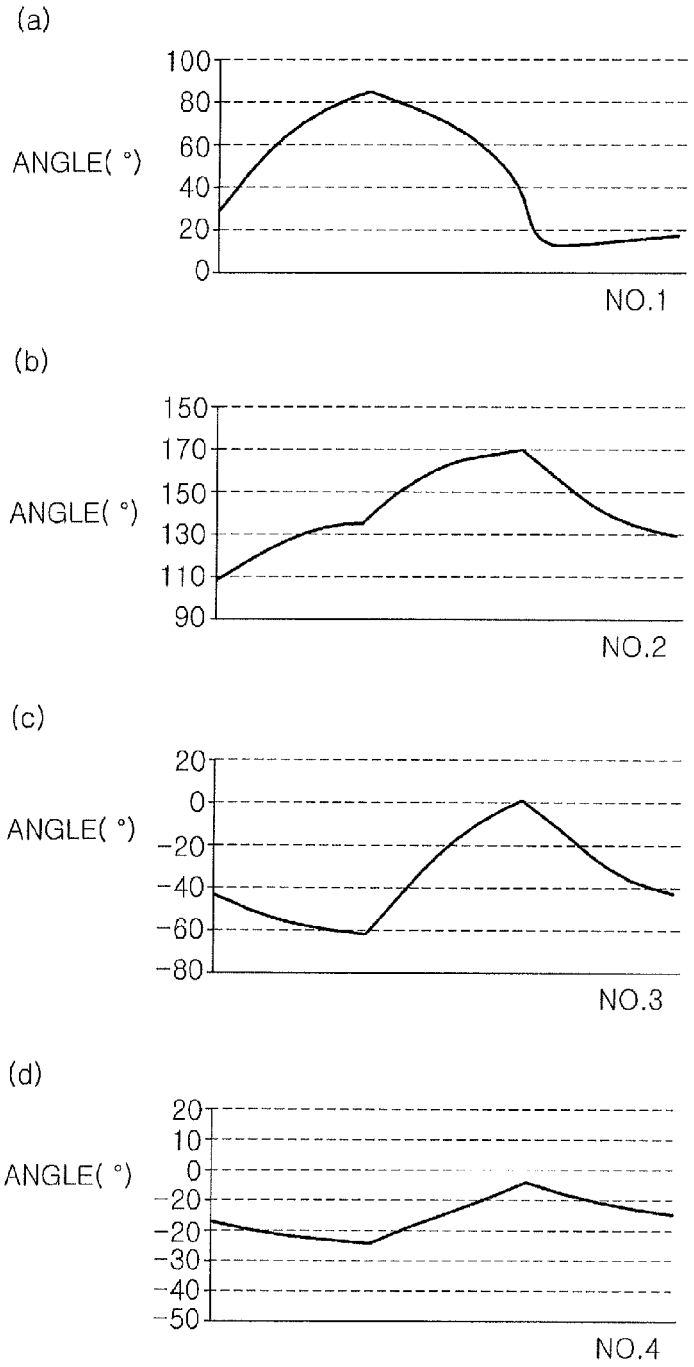
FIG. 9 is a graph showing the rotational angle of first, second, third, and fourth shoulder driving unit according to the present invention.
Figure 10:
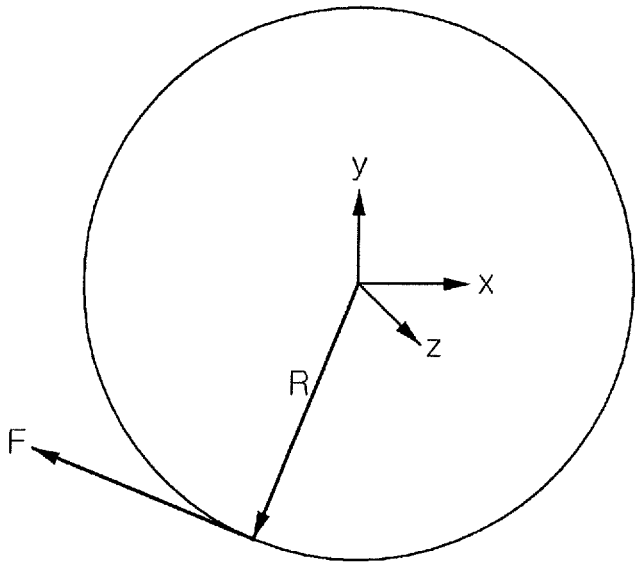
FIG. 10 is a schematic view illustrating the generation of a motion intent signal by first and second load cells and small changes of each axis where an end-effector intends to move.

The first, second, third, and fourth shoulder joint driving units 310, 320, 330, 340 are each rotated within the limit angle of the shoulder joint, as can be seen from the graph shown in FIG. 9, and perform an operation of four degrees of freedom with movement of the connecting links 315, 325, 335, 362, 364.

Accordingly, since the operation of four degrees of freedom is made for a three-axial movement, a spare angle is provided for a rotational angle between the driving units.

Further, the first and second load cells 510, 520 dispose where the lower/upper link arms divided up/down and detects one-directional movement of the muscle by detecting separation of the divided lower/upper links which is generated by movement of the muscle. The second load cell 520 detects a two-directional movement that is generated by abduction/adduction and then creates motion intent signals dx and dz by multiplying a coefficient K by force in the detected first and second directions.

The motion intent signals dx and dz implement small change of each axis where an end-effector, which is created by analyzing the elements of magnitude and direction of the force signals detected by the first and second load cells 510, 520, intends to move.

The end-effector is always positioned at a distance R from the rotational point $x_0$, $y_0$, $z_0$ of the shoulder joint, such that dy can be obtained from the small changes of the two axis and the following equation.

$$x_0+dz=x,$$

$$z_0+dx=z,$$

$$R=\sqrt{X^2+y^2+Z^2}$$

$$y=\sqrt{R^2-=(x^2+z^2)}$$

$$y-y_0=dy \qquad \text{[Equation 1]}$$

The final goal-position of the end-effector can be induced by adding up the small changes per hour dx, dy, dz in each axis that are obtained by the input force and coefficient K to the initial position of the end-effector before the robot is actuated.

The coefficient K is variably set by the user's muscular force, which is not described in detail herein.

Further, the coordinates of the goal-position of the end-effector induced as described above is used to estimate the motional angle of the robot unit by Inverse Kinematics, which is referred to as a 3D-joint motion animation, and the robot unit 300 performs an operation in an F-direction.

As the angles of movements are calculated for the motion intent signals, the control unit 550 adjusts rotational force by outputting control signals to the motors of the first, second, third, and fourth shoulder joint driving units and the elbow joint driving unit 350.

Therefore, the movements of the first, second, third, and fourth shoulder joint driving units 310, 320, 330, 340 perform an operation of four degrees of freedom while complementing each other, which can be seen from the graph shown in FIG. 9

That is, the elbow joint driving unit 350 makes extension/flexion motion of the lower arm of the human body and the first, second, third, and fourth shoulder joint driving units 310, 320, 330, 340 make movement of the shoulder joint (extension/flexion, abduction/adduction, internal/external rotation, and redundant operation) by rotating the connecting links 315, 325, 335.

Further, when the user selects the continuous passive motion mode, the first, second, third, and fourth shoulder joint driving units 310, 320, 330, 340 are operated along the programmed path, regardless of the user's motion intent signal and the elbow joint driving unit 350 is operated, such that the user's limbs are moved.

What is claimed is:

1. A wearable robot system for rehabilitation training of an upper limb, comprising:

a robot unit that is configured to be attachable to and detachable from the upper limb of a human body, wherein the robot unit comprises:

a plurality of shoulder joint driving units, and an elbow joint driving unit, wherein the plurality of shoulder joint units and the elbow joint driving unit are configured for extension and flexion of an elbow joint of the upper limb and a shoulder joint of the upper limb, and for abduction and adduction of the shoulder joint;

a station unit that supports the robot unit and adjusts an vertical position and a horizontal position of the robot unit;

a sensing unit that is disposed in the robot unit, that detects motion of the upper limb using sensors, and outputs detected motion of the upper limb into an electric signal; and a control unit that controls an operation of the shoulder joint driving unit and the elbow joint driving unit in response to the electric signal from the sensing unit.

2. The wearable robot system for rehabilitation training of the upper limb according to claim 1, wherein the station unit comprises:

a movable bed that is disposed to fix an end of the robot unit and actuated by a linear actuator to move the robot unit horizontally;

an elevation bed that is disposed under the movable bed to expand and/or contract and actuated by a linear actuator to move the movable bed vertically; and a base that is disposed under the elevation bed to support the elevation bed.

3. The wearable robot system for rehabilitation training of the upper limb according to claim 1, wherein the sensing unit comprises a plurality of load cells that are configured to be disposed correspondingly to a side of the upper limb and configured to output an electric signal corresponding to a force transmitted from the motion of the upper limb.

4. The wearable robot system for rehabilitation training of the upper limb according to claim 3, wherein the plurality of load cells comprises:

a first load cell that detects movement of the elbow joint using a one-axial detection method and outputs a motion intent signal corresponding to the movement of the elbow joint; and a second load cell that is spaced apart from the first load cell, the second load cell that detects the movement of the elbow joint using a two-axial detection method, and outputs a motion intent signal corresponding to the movement of the elbow joint.

5. The wearable robot system for rehabilitation training of the upper limb according to claim 1, wherein the robot unit is attachable to and detachable from the upper limb of the human body with a binding band that is disposed in a string shape at a side of the robot unit and of which both ends are attachable and detachable by hook and loop fastener tapes.

6. The wearable robot system for rehabilitation training of the upper limb according to claim 1, wherein the robot unit comprises connecting links that are each disposed between the plurality of shoulder joint driving units and the elbow joint driving unit, wherein the plurality of shoulder joint driving units and the elbow joint driving unit are rotatably connected to each other through the connecting links.

7. The wearable robot system for rehabilitation training of the upper limb according to claim 6, wherein each of the plurality of shoulder joint driving units and the elbow joint driving unit comprises:

motors, wherein each of the motors includes a motor shaft driven in response to a received electric signal and provides a rotational force for the connecting links; and a power transmitting unit that transmits the rotational force to the connecting links.

8. The wearable robot system for rehabilitation training of the upper limb according to claim 6, wherein the plurality of shoulder joint driving units are arranged at different angles through the connecting links such that the robot unit does not interfere with the human body.

9. The wearable robot system for rehabilitation training of the upper limb according to claim 7, wherein the robot unit comprises a first, a second, a third, and a fourth shoulder joint driving units that are connected to each other by the connecting links.

10. The wearable robot system for rehabilitation training of the upper limb according to claim 9, wherein one of the connecting links that is disposed between the fourth shoulder driving unit and the elbow joint driving unit comprises:

upper link arms that are adapted to be disposed corresponding to an upper arm of the human body, wherein the upper link arms are configured to adjust a length of the upper link arms by a connecting means; and lower links arms that are adapted to be disposed at an end of the elbow joint driving unit corresponding to a lower arm of the human body.

11. The wearable robot system for rehabilitation training of the upper limb according to claim 9, wherein a central axis of each of the motors of the first, the second, the third, and the fourth shoulder joint driving units are arranged to cross a central axis of the shoulder joint.

12. The wearable robot system for rehabilitation training of the upper limb according to claim 1, further comprising a selecting means that allows a user to select a voluntary motion mode or a continuous passive motion mode for an operation of the robot unit, wherein the selecting means that makes the control unit control an operation of the plurality of shoulder joint driving units and the elbow joint driving unit, in response to a signal transmitted from a selecting switch for selecting the voluntary motion mode or the continuous passive motion mode.

* * * * *